United States Patent [19]

Peffer

[11] Patent Number: 4,547,058

[45] Date of Patent: Oct. 15, 1985

[54] SHEET FILM BUFFER STATION

[75] Inventor: Robert M. Peffer, Penfield, N.Y.

[73] Assignee: Eastman Kodak Company, Rochester, N.Y.

[21] Appl. No.: 565,935

[22] Filed: Dec. 27, 1983

[51] Int. Cl.[4] ..... G03G 15/00

[52] U.S. Cl. ..... 355/3 SH; 355/14 SH; 271/3

[58] Field of Search ..... 355/3 SH, 14 SH; 271/3

[56] References Cited

U.S. PATENT DOCUMENTS

| | | | |
|---|---|---|---|
| 3,083,869 | 4/1963 | Crumrine et al. | 221/293 |
| 3,615,414 | 10/1971 | Light . | |
| 3,698,602 | 10/1972 | Guage . | |
| 4,049,255 | 9/1977 | Stange et al. | 271/3 |
| 4,059,260 | 11/1977 | Stange et al. | 271/3 |
| 4,067,649 | 1/1978 | Hubbard et al. | 355/3 SH |
| 4,089,515 | 5/1978 | Stange et al. | 271/3 |
| 4,109,903 | 8/1978 | Stange et al. | 271/3 |

*Primary Examiner*—A. T. Grimley
*Assistant Examiner*—David Warren
*Attorney, Agent, or Firm*—Larry P. Kessler

[57] ABSTRACT

In an electrographic copier, a buffer station for storing discrete sheets, adapted to have transferable images formed respectively thereon, and for distribution of such sheets into a track assembly where such sheets are transported into operative relation with electrographic process stations of such copier. The buffer station safely stores a plurality of sheets in spaced relation to prevent contact between adjacent sheets. The buffer station is indexable relative to the track assembly for alignment with such track assembly so as to receive a sheet from or distribute a sheet to the track assembly. The stored sheets are selectively released from the buffer station when respectively aligned with the track assembly.

7 Claims, 4 Drawing Figures

SHEET FILM BUFFER STATION

BACKGROUND OF THE INVENTION

This invention relates generally to electrographic copier apparatus utilizing a plurality of discrete film sheets, and more particularly to a sheet film buffer station for such apparatus.

In copending U.S. patent application Ser. No. 427,238 filed Sept. 29, 1982 in the name of Kindt, an electrophotographic copier is described which utilizes a plurality of discrete sheets of photoconductive film. The film sheets are transported seriatim about a continuous path track assembly into operative relation with electrographic process stations. In the reproduction process, in order, each film sheet is uniformly charged, exposed to a light image of a document to be reproduced to form a charge pattern on such sheet, and developed with pigmented thermoplastic marking particles electrostatically attracted to the charge pattern to form a transferable image corresponding to the document image. The transferable image is then transferred to a receiver member to form the document reproduction and the sheet is cleaned for reuse. An advantage to using the plurality of discrete film sheets, as contrasted to the use of a continuous photoconductive web or drum, is that the rate of movement of the respective film sheets through the process stations can be varied to optimize the operation of each process station on the film sheets.

The path length of the track assembly is desirably long enough to accommodate the total number of film sheets between the last station of the reproduction process and the first station. The reason for having such path length is so that, after completion of a reproduction run, no sheet remains in intimate relation with any process station where damage to that sheet by remaining in such station could occur. Alternatively, the track assembly may include a storage chamber, or buffer station, to hold the film sheets between reproduction runs. The employment of a buffer station has significant advantages over the continuous path track assembly in that it shortens the overall path length of the track assembly. That is, the distance between the last process station and the first station, required to accommodate the total number of film sheets, is reduced. Further, the buffer station can store film sheets for a time sufficient to compensate for any variation in the time it takes for individual sheets to complete their travel through a cycle of the reproduction process. By selectively holding individual sheets in the buffer station for an appropriate length of time, the sheets are prevented from bumping into one another due to a cummulative effect of different travel speeds of respective sheets.

A buffer station for rigid photoconductive film plates is shown in U.S. Pat. No. 3,698,602, issued Oct. 17, 1972, in the name of Gnage. In the buffer station of this patent, the film plates, with integral spacers, are in contact with one another and progress seriatim from an entrance location to an exit location. Accordingly, such station would not be suitable for use with non-rigid film sheets. Such plates must be maintained separated by the spacers to prevent damage to the plate surfaces, such as by rubbing contact between the surfaces of adjacent plates. Moreover the travel path of the plates through such buffer station elongates the total plate travel path (when the distance necessary to travel between entrance and exit location of the buffer station is included). Additionally, such buffer station only allows distribution of the plates from the station into the travel path in the same order in which they are received in the station (first plate in is first plate out).

SUMMARY OF THE INVENTION

This invention is directed to a buffer station for discrete sheets, adapted to have transferable images formed respectively thereon, and employed for making reproductions in an electrographic copier. The buffer station safely stores such film sheets without damage to the sheet surfaces and distributes such sheets into a track assembly where such sheets are transported into operative relation with electrographic process stations of such copier. A plurality of sheets are stored in the buffer station in spaced relation to prevent contact between adjacent sheets. The buffer station is indexable relative to the track assembly for alignment with such track assembly so as to receive a sheet from or distribute a sheet to the track assembly. The stored sheets are selectively released from the buffer station when respectively aligned with the track assembly.

The invention, and its objects and advantages, will become more apparent in the detailed description of the preferred embodiment presented below.

BRIEF DESCRIPTION OF THE DRAWINGS

In the detailed description of the preferred embodiment of the invention reference is made to the accompanying drawings, in which.

DESCRIPTION OF THE PREFERRED EMBODIMENT

Figure 1:
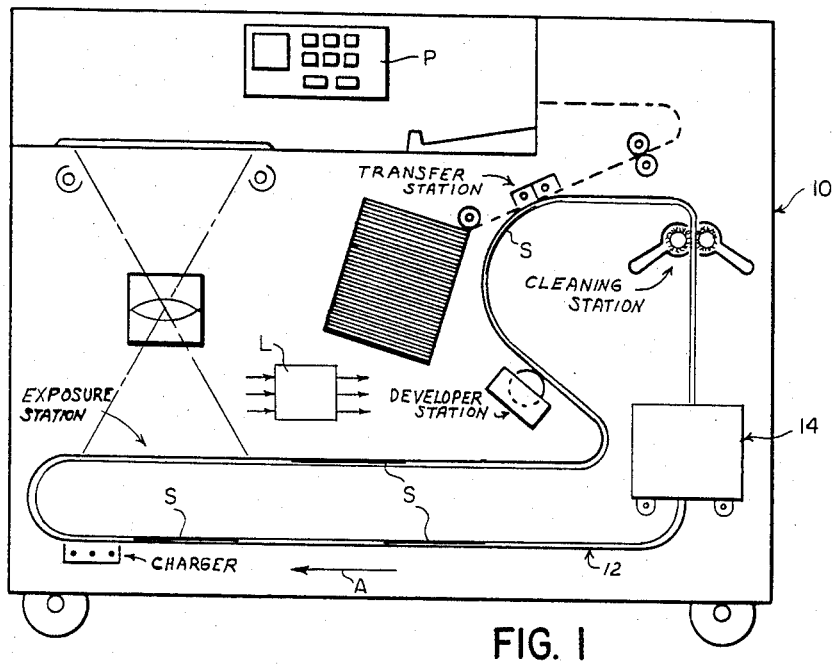
FIG. 1 is a schematic illustration of an electrographic copier including a track assembly for transporting discrete film sheets into operative relation with electrographic process stations of such copier, and a buffer station for such sheets, according to this invention.

Referring now to the accompanying drawing, an electrographic copier 10 employing discrete film sheets S transported about a track assembly 12 is schematically shown in FIG. 1. The track assembly 12 is arranged in a closed loop path associated with typical electrographic process stations. Film sheets, transported about the track assembly 12 in the direction of arrow A, are successively brought seriatim into operative relation with such electrographic process stations to enable copies of input information (e.g. documents) to be reproduced on such sheets respectively. That is, one film sheet is employed for making one reproduction. The discrete film sheets are formed, for example, from material including a photoconductive layer such as described in U.S. Pat. No. 3,615,414 issued Oct. 26, 1971 in the name of Light. A buffer station 14 according to this invention, for safely storing and selectively distributing film sheets, is located in a portion of the path of the track assembly 12 between the last station of the reproduction process cycle (cleaning station) and the first station (charger).

Control of the copier 10 is accomplished by a logic and control unit L including a microprocessor for example. The microprocessor receives operator input signals from an input panel P and timing signals, for example from sensors (not shown) detecting transport of the film sheets about the track assembly. Based on such signals and a program for the microprocessor, the unit L produces signals to control the transport of the film sheets and the timing of operation of the various electrographic process stations for carrying out the reproduction process. The production of a program for a number of commerically available microprocessors such as INTEL model 8080 or model 8085 microprocessor (which along with others are suitable for use with the invention), is a conventional skill well understood in the art. Programmer having ordinary skill in the art to the particular details of any such program would, of course, depend on the architecture of the designated microprocessor.

Figure 2:
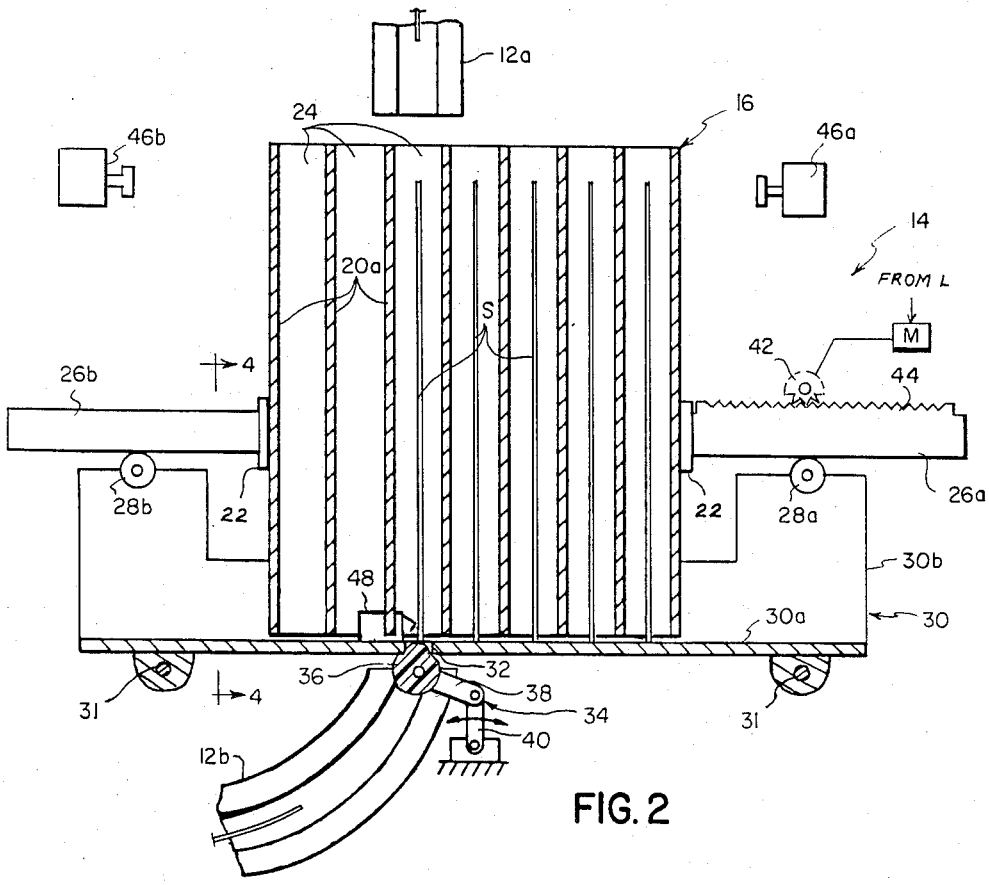
FIG. 2 is a side elevational view, partly in cross-section and on an enlarged scale, of the buffer station according to this invention.
Figure 3:
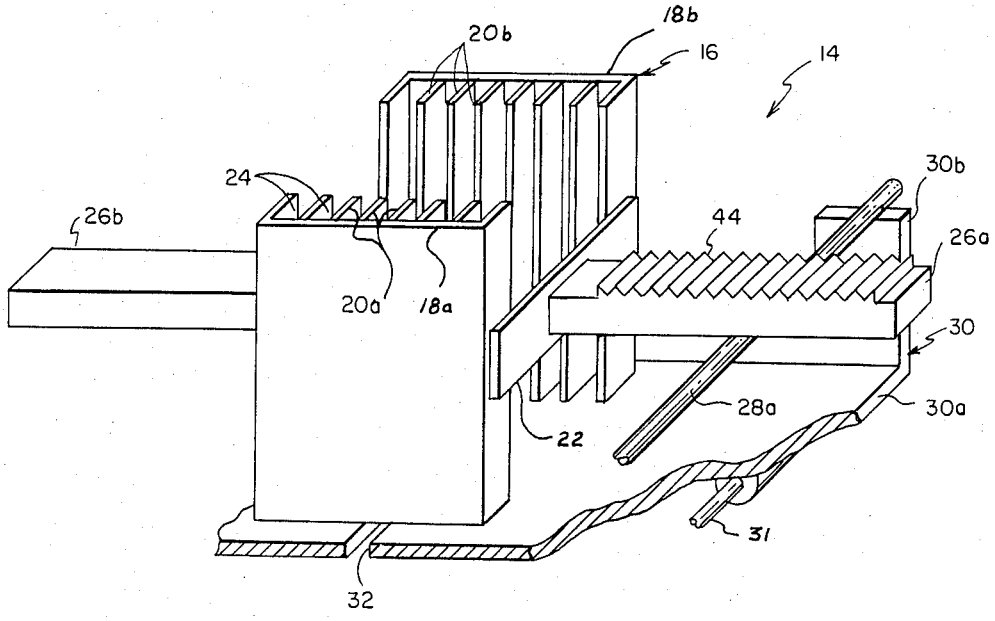
FIG. 3 is a view, in perspective, of a portion of the buffer station of FIG. 2 with portions removed or broken away to facilitate viewing.
Figure 4:
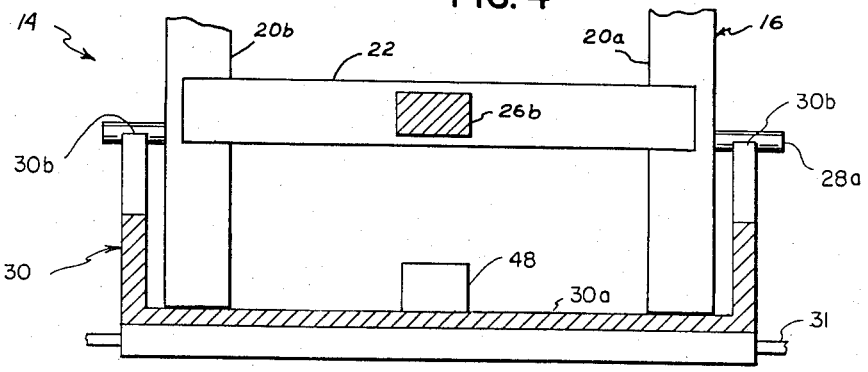
FIG. 4 is an end elevational view of a portion of the buffer station in section taken along lines 4—4 of FIG. 2.

The buffer station 14 includes a housing 16 and a support member 30 for such housing (see FIGS. 2 through 4). The housing 16 is defined by a pair of side walls 18*a*, 18*b* maintained in a fixed spacial relation by brace members 22. A plurality of parallel ribs 20*a*, 20*b* are connected to and extend perpendicularly from the side walls 18*a*, 18*b* respectively. The ribs 20*a*, 20*b* form opposed cavities 24 for receiving the marginal edge portions of discrete film sheets S, and divide the housing 16 into a plurality of chambers for storing the discrete film sheets respectively in spaced relation. The dimension of the ribs 20*a*, 20*b*, measured from the side walls 18*a*, 18*b* respectively is selected to be of an extent where only that portion of the marginal edges of the film sheets outside the respective image-receiving surface areas is contacted by such ribs. The spaced relation of the film sheets in the chambers prevents the sheets from rubbing against one another and scratching or otherwise damaging an image-receiving surface of a film sheet. A pair of arms 26*a*, 26*b* are attached to the outboard sides of brace members 22 respectively and extend laterally therefrom.

The support member 30 is of a generally U-shaped configuration having a base plate 30*a* and upstanding side walls 30*b*. Roller bearings 28*a*, 28*b*, carried by the side walls 30*b* support the arms 26*a*, 26*b* for ready movement of the housing 16 relative to the support member 30. The support member 30 is mounted on parallel, substantially horizontal guide rails 31 located in the apparatus 10 transverse to the track assembly 12. The support member is selectively movable along the rails 31 to locate the housing 16 in an operative position in line with the track assembly 12 between an upstream portion 12*a* of such assembly and a downstream portion 12*b*, or at a position accessible from the exterior of the copier 10. When the housing 16 is located in such accessible position, an operator may preload discrete sheets S into the chambers or may replace any one of the sheets.

The base plate 30*a* of the support member 30 is in juxtaposition with the bottom of housing 16. A slotted opening 32 is formed in the base plate 30*a* at a position whereby when the support member 30 is moved to locate the housing 16 in its operative position, the opening is adjacent to and aligned with the downstream portion 12*b* of track assembly 12. The base plate 30*a* thus serves to retain discrete film sheets S in their respective chambers, with the exception of the chamber aligned with the opening 32.

A gate 34 is associated with the opening 32. The gate 34 selectively blocks the opening 32 to retain a film sheet in the chamber aligned with the opening, or clears the opening to enable the sheet in such aligned chamber to drop into the portion 12*b* of track assembly 12 under the influence of gravity. Of course, a suitable mechanism could be provided to positively feed the sheet from such chamber. The gate 34 is, for example, a compliant roller 36 mounted on pivotable interconnected linkage arms 38 and 40. When the arm 40 moves in a clockwise direction (as viewed in FIG. 2), arm 38 moves the roller 36 to the right away from the opening 32; conversely, when the arm 40 moves in a counterclockwise direction, arm 38 moves the roller to the left to block the opening 32. The compliant nature of the roller 36 causes a portion of the roller to enter the opening and form a substantially planar surface with the sheet supporting surface of plate 30*a*. In this manner a film sheet aligned with opening 32 is prevented from prematurely entering the opening.

Movement of the housing 16 to align the film sheets in the chambers respectively with the track assembly 12 is effected, for example, by a reversible indexing motor M controlled by the logic and control unit L. The motor M rotatably drives a gear 42 supported to mesh with a rack 44 fixed on arm 26*a*. The gear 42 is rotated by the motor M through a preselected angular displacement (either clockwise or counterclockwise as viewed in FIG. 2) to move the rack, and thus the housing 16, transversely through a distance substantially equal to the distance between longitudinal centerlines of adjacent chambers. Accordingly, the actuation of the motor M selectively indexes the chambers for the desired alignment of such chambers respectively with the track assembly.

In operation, with a desired number of discrete film sheets S preloaded in respective housing chambers, and with the housing in its operative position relative to track assembly 12, the motor M is energized to move the housing to its rightmost position against a first limit switch 46*a*. The switch 46*a* produces a signal indicative of the housing being in such position, and in response to such signal the motor M is energized to index the housing 16 until the first chamber containing a film sheet is aligned with track assembly portion 12*b*. Such alignment is sensed by a sheet detection switch 48 mounted on the base plate 30*a* adjacent to the opening 32 (see FIG. 2). When the film sheet in the left-most chamber containing a film sheet engages the switch 48, the switch produces a signal indicating such chamber (and its film sheet) is aligned with track assembly portion 12*b*. The motor M is then deenergized in response to such signal.

Thereafter, when a film sheet is called for by the copier 10 for reproduction of input information, the gate 34 is actuated for movement away from its position where it blocks the opening 32. The aligned film sheet then drops, under the influence of gravity, into track assembly portion 12*b* for transport through the electrographic process stations of copier 10. The switch 48 detects the exit of the sheet from the chamber and produces a signal indicative thereof. In response to such signal, and after a preselected time to allow the film sheet to fully enter the track assembly portion 12*b*, the gate 34 is actuated to return to its opening blocking position. When more than one sheet is called for, such as for example upon making of multiple reproductions of the input information, the motor M is energized in response to the sheet exit signal to index the housing 16 for alignment of subsequent chambers respectively with the track assembly portion 12*b*. The gate 34 is similarly actuated at timed intervals so that the film sheets contained in aligned chambers respectively drop from such chambers into track assembly portion 12*b*. When a discrete film sheet has completed its travel about the operative path through track assembly 12, it is returned to the housing 16 from track assembly portion 12*a* and received in an aligned (empty) chamber.

There are three basic operative cycles for the buffer station 14 which are dependent on respective modes of operation of the copier 10. In the first mode, only one discrete film sheet is called for by the copier 10, such as when only one reproduction of input information is to be made. Such one film sheet is released from its chamber aligned with the track assembly portion 12*b* into such portion by movement of the gate 34 away from opening 32. After such sheet is released, the gate 34 returns to its opening blocking position and indexing of the housing 16 is inhibited. Therefore, after the released sheet completes transport about the track assembly 12, such film sheet returns to the same chamber from which it was released, and it is retained in such chamber for subsequent use.

In a second mode, a particular number of film sheets (equal to or less than the total number of available film sheets) are called for by the copier 10 corresponding, for example, to the number of reproductions to be made. The film sheets are sequentially released from their respective chambers into track assembly portion 12*b* by selective movement of the gate 34 in timed relation with indexing of the housing 16 to the left (as viewed in FIG. 2) to respectively align the chambers with such track assembly portion. Such indexing of the housing is effected by the motor M in the above described manner. After the release of the last of the particular number of film sheets from its respective chamber, indexing of the housing 16 is inhibited and the housing remains in the position where such chamber is in alignment with the track assembly portion 12*a* to receive the first of the film sheets returning to the buffer station 14. The first returning film sheet (first film sheet released from the buffer station) is returned to such chamber, and such return is sensed by switch 48. Switch 48 produces a signal indicative of the return of such film sheet, and in response to such signal the housing is indexed to the right to align the adjacent chamber with portion 12*a* to receive the next returning film sheet. This sequential indexing of the housing 16 is repeated as the remaining sheets are returned to respective chambers.

It is apparent that in this second operative cycle of the buffer station 14, the film sheets are shuffled on return to chambers; that is, the sheets are returned to respective chambers in a reverse order from the order in which they were originally stored in the chambers. Thus the last film sheet returned to the buffer station during an operative cycle of the buffer station becomes the first sheet used in a subsequent operative cycle. This reversal of the order of the film sheets in the chambers of the buffer station assures that the sheets are statistically used substantially equally. Equalization of the use of the film sheets serves to prolong the useful life of the sheets.

In a third mode of operation of the copier 10, a number of reproductions greater than the number of available film sheets are called for. During this mode of operation (reproduction run), the film sheets are sequentially released from their respective chambers into track assembly portion 12*b* by selective movement of the gate 34 in timed relation with indexing of the housing 16 to the left, as described with reference to the second mode of operation, until the housing engages limit switch 46*b* and the sheet in the last (right-most) chamber is released. After release of the last film sheet, indexing of the housing 16 is inhibited and the housing remaining in its left-most position with the right-most chamber aligned with the track assembly portions 12*a*, 12*b*. The film sheets are then continuously transported about the track assembly (and through such aligned chamber). The gate 34 is held out of its opening blocking position during this continuous transport for free passage of the film sheets through the buffer station. Alternatively, the gate may be moved into its opening blocking position in timed relation with return of a film sheet to the aligned chamber (momentarily stopping such sheet) and then moved to its position away from the opening to insure that each film sheet leaves the chamber at a preselected time. At the end of the reproduction run, the film sheets are returned for storage in respective chambers in a similar manner to that described with reference to the second mode of operation.

During the continuous portion of this reproduction run, the path length about the track assembly 12 through right-most chamber is the same for each film sheet and is the minimum distance of sheet travel for each cycle about the track assembly. While the travel speed of individual sheets may vary during transport through selected electrographic process stations, the average speed for each film sheet is substantially the same for its complete cycle about the track assembly. Therefore, the respective film sheets travel over the same path length, and the travel time about such path during one cycle is substantially the same for each sheet. Such equal path length and travel time facilitates timing and control of the electrographic process stations of the copier 10, and improves productivity by providing a minimum distance of travel and travel time for each film sheet about the track assembly 12.

The invention has been described in detail with particular reference to a preferred embodiment thereof, but it will be understood that variations and modifications can be effected within the spirit and scope of the invention.

We claim:

1. In an electrographic copier employing a plurality of discrete sheets adapted to have transferable images formed respectively thereon, said copier including a track assembly associated with electrographic process stations and having first and second remote portions where such discrete sheets respectively egress from and enter said track assembly, such sheets being transported about said track assembly into operative relation with such stations, a discrete sheet buffer station associated with said track assembly, said buffer station comprising:

means for safely storing such discrete sheets, in spaced relation, and so as to substantially prevent contact of the respective surfaces of such sheets;

means for indexing said storing means relative to said track assembly to align said storing means with said track assembly at a location adapted to selectively receive a sheet egressing from said first portion of said track assembly, and distribute a sheet to enter said second portion of said track assembly; and means operatively associated with said storing means for selectively releasing a stored sheet for distribution into said second portion of said track assembly.

2. The invention of claim 1 wherein said storing means includes a housing having first and second spaced side walls adapted to respectively contact only opposed marginal edges of said sheets, a plurality of ribs connected to and extending perpendicularly from said side walls respectively to define a plurality of discrete sheet storing chambers.

3. The invention of claim 2 wherein said ribs extend from said respective side members a distance so as to engage only a minor portion of the surfaces of discrete sheets, received in said storing chambers, adjacent to such opposed marginal edges thereof.

4. The invention of claim 2 wherein said indexing means includes a reversible motor, means for coupling said motor to said housing so that when said motor is actuated said housing moves relative to said track assembly, and means for actuating and deactuating said motor to selectively align a storing chamber of said housing with said track assembly whereby a discrete sheet stored in such chamber is releasable into said second portion of said track assembly, and a discrete sheet from said first portion of said track assembly is receivable in such chamber.

5. The invention of claim 4 wherein said actuating-/deactuating means includes a switch located relative to said track assembly for sensing the presence or absence of a sheet in a chamber aligned with said track assembly and producing signals respectively indicative thereof, and wherein said motor indexes said housing relative to said track assembly in response to such signals.

6. The invention of claim 1 further comprising means for supporting said storing means, said support means including means for enabling said storing means to move relative to said support means when indexed by said indexing means, and a member underlying said storing means to retain sheets therein, said member defining an opening aligned with said second portion of said track assembly and of a dimension to enable a sheet, upon release for distribution by said releasing means, to pass therethrough into said portion.

7. The invention of claim 6 where said releasing means includes a movable gate, and means for selectively moving said gate between a position for blocking said opening and a position remote from such opening blocking position.

* * * * *